US005643111A

United States Patent [19]

Igarashi

[11] Patent Number: 5,643,111

[45] **Date of Patent: *Jul. 1, 1997**

[54] GOLF CLUBS WITH ELASTOMERIC VIBRATION DAMPENER

[76] Inventor: Lawrence Y. Igarashi, 30231 Tomas Rd., Rancho Santa Margarita, Calif. 92688

[ * ] Notice: The term of this patent shall not extend beyond the expiration date of Pat. No. 5,637,045.

[21] Appl. No.: 502,262

[22] Filed: Jul. 13, 1995

Related U.S. Application Data

[63] Continuation-in-part of Ser. No. 461,574, Jun. 2, 1995.

[51] Int. Cl.[6] ..... A63B 53/04

[52] U.S. Cl. ..... 473/332; 473/340; 473/350; 473/346; 273/DIG. 8

[58] Field of Search ..... 273/167 R, 167 H, 273/169, 167 F, 80.1, 80.2, DIG. 3, DIG. 8, DIG. 10, 77 R, 170, 171, 172, 173; 473/324, 326, 329, 334, 335, 341, 342, 345, 346, 349, 332, 350

[56] References Cited

U.S. PATENT DOCUMENTS

| | | | |
|---|---|---|---|
| 1,658,581 | 9/1928 | Tobia . | |
| 1,968,627 | 7/1934 | Young | 273/77 |
| 2,846,228 | 8/1958 | Reach | 273/169 |
| 4,582,321 | 4/1986 | Yoneyama | 273/78 |
| 4,811,950 | 3/1989 | Kobayashi | 273/171 |
| 4,869,507 | 9/1989 | Sahm | 273/167 H |
| 4,872,683 | 10/1989 | Doran | 273/167 H |
| 4,875,679 | 10/1989 | Movilliat et al. | 273/73 |
| 4,928,972 | 5/1990 | Nakanishi et al. | 273/78 |
| 4,964,640 | 10/1990 | Nakanishi et al. | 273/167 |
| 5,000,454 | 3/1991 | Soda | 273/167 |
| 5,067,715 | 11/1991 | Schmidt et al. | 273/167 |
| 5,083,778 | 1/1992 | Douglass | 273/78 |
| 5,106,094 | 4/1992 | Desbiolles et al. | 273/167 |
| 5,213,328 | 5/1993 | Long et al. | 273/167 |
| 5,244,211 | 9/1993 | Lykasiewicz | 273/167 H |
| 5,312,105 | 5/1994 | Cleveland | 273/167 |
| 5,316,298 | 5/1994 | Hutin et al. | 273/78 |
| 5,351,958 | 10/1994 | Helmstetter | 273/167 H |

FOREIGN PATENT DOCUMENTS 2672226 8/1992 France .

OTHER PUBLICATIONS

BJB Enterprises, Inc. Products, Material Safety Data Sheet F–70 A/B 70 Shore A Polyurethane Elastomer.

"New medallions provide golfers good vibrations," J. Achenbach, Golfweek, Mar. 25, 1995.

BJB Enterprises, Inc. Products, Material Safety Data Sheet WC–575 A/B Water Clear Aliphatic Polyurethane Elastomer.

*Primary Examiner*—Sebastiano Passaniti

*Attorney, Agent, or Firm*—Larry K. Roberts

[57] ABSTRACT

A hollow wood-type golf club is fabricated with a thin layer of elastomeric dampening material coating the inner surface region opposite the ball impacting face and within the hollow cavity of the head shell. The layer provides vibration dampening, improving the play of the club. A low cost, simple method to fabricate the head with the layer includes dispensing a quantity of uncured elastomer in liquid form into the cavity, maintaining the head with the inner surface opposite the ball impacting face at a horizontal attitude to cause the liquid to pool over this inner surface region, and curing the elastomer with the head in this attitude until the elastomer has cured and hardened. Golf iron and putter clubs are described with a vibration dampener consisting of a thin layer of elastomer material adhered to a base cavity surface of a cavity backing the ball impacting surface. Methods for fabricating the iron and putter clubs are described.

37 Claims, 6 Drawing Sheets

FIG. 6
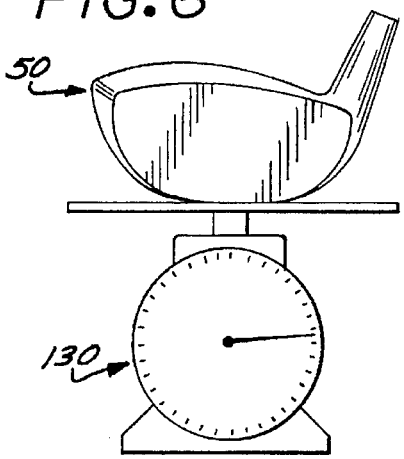
FIG. 7
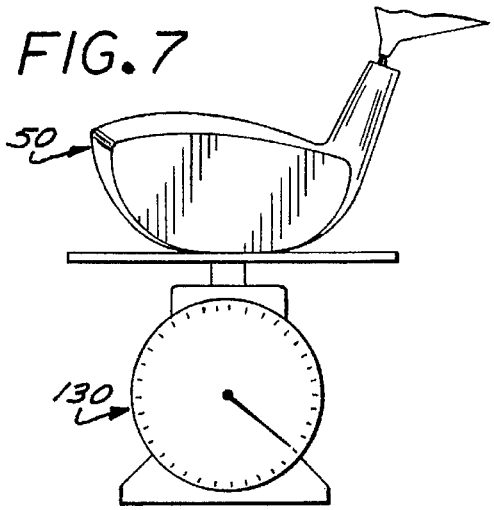
FIG. 8
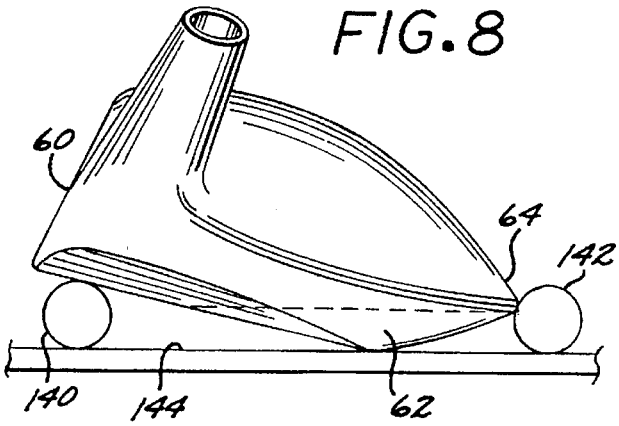
FIG. 9
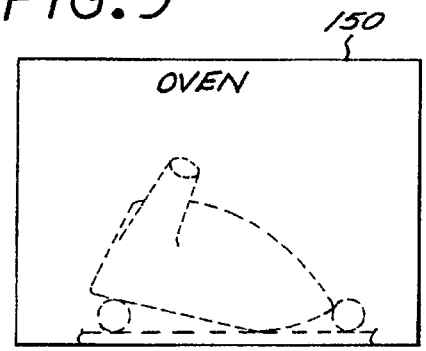
FIG. 10
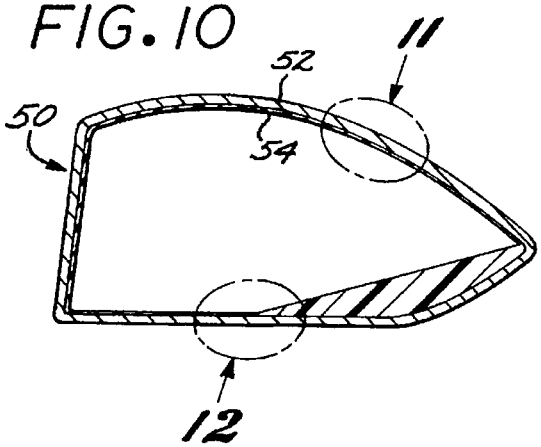
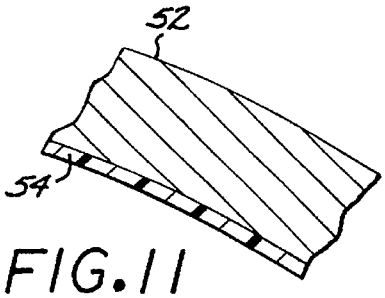
FIG. 11
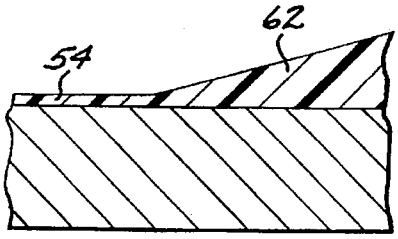
FIG. 12

FIG. 19
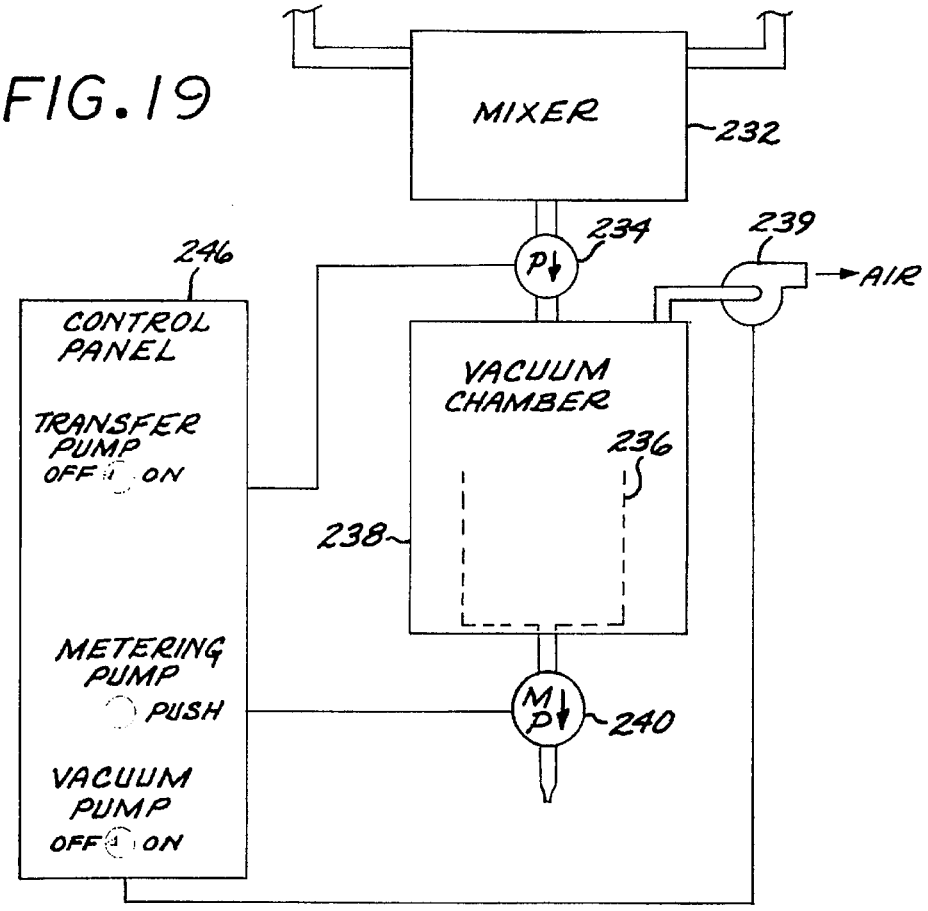
FIG. 20
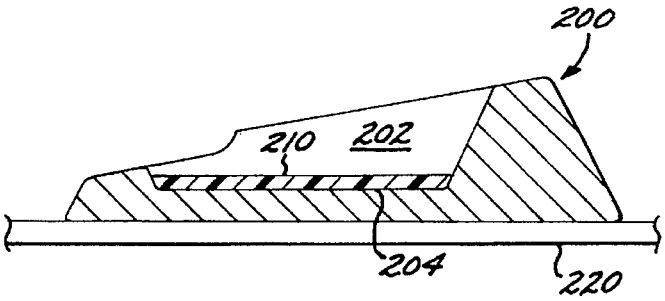
FIG. 21
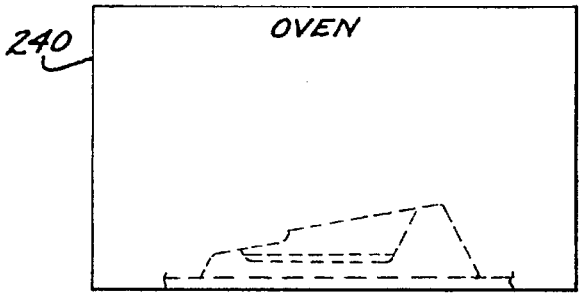
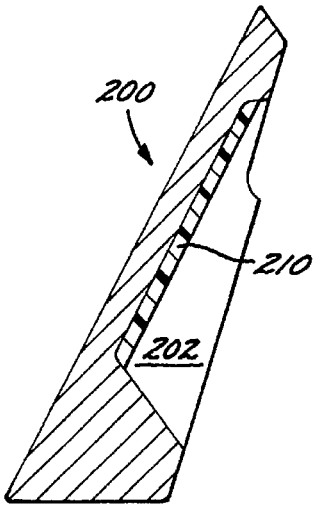
FIG. 22

FIG. 23
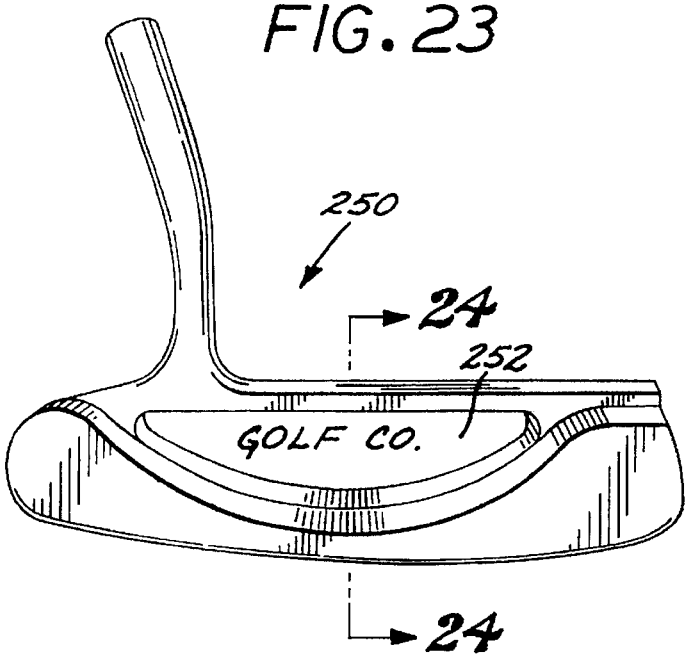
FIG. 24
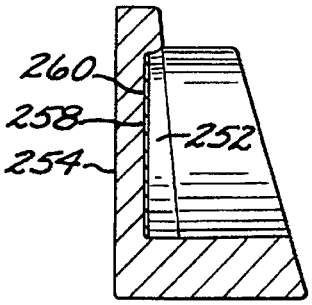
FIG. 25
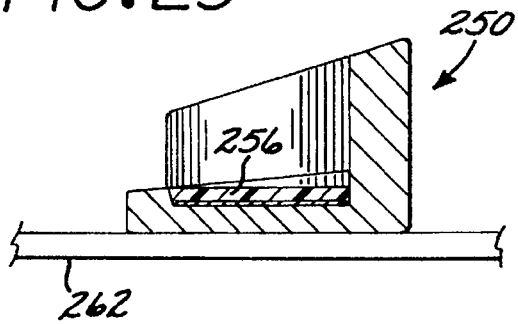
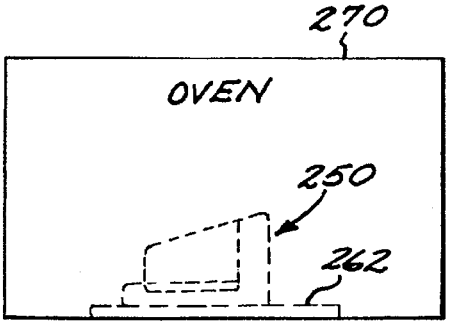
FIG. 26
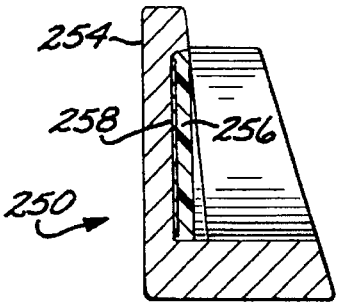
FIG. 27

GOLF CLUBS WITH ELASTOMERIC VIBRATION DAMPENER

This is a continuation-in-part of application Ser. No. 08/461,574, filed Jun. 2, 1995, entitled "METAL WOOD GOLF CLUB WITH VIBRATION DAMPENING," by L. Igarashi.

TECHNICAL FIELD OF THE INVENTION

This invention relates to golf clubs, and more particularly to golf clubs with vibration dampening, and to methods for making such clubs.

BACKGROUND OF THE INVENTION

Hollow "wood"-type golf club heads are now in widespread use, and typically are fabricated of a thin hollow shell to which is attached a club shaft. These types of clubs have largely replaced the true wood clubs actually fabricated from persimmon wood, and are used as drivers and fairway "woods." The shell is typically a metal such as stainless steel, aluminum or titanium alloy, but other materials also include graphite, ceramics, polycarbonates and plastics.

A problem associated with golf clubs is the vibration generated from impact with the ball. In some hollow wood-type clubs, the hollow shell may be filled with a foam urethane, which tends to provide some vibration dampening. However, over time and as the result of play with the club, the foam may degrade, and become detached from the interior surface of the head, thereby causing annoying rattles and sounds. Irons and putters are also subject to vibration.

SUMMARY OF THE INVENTION

A vibration-dampened hollow "wood"-type golf club is described, comprising a club shaft and a "wood"-type club head. The head comprises a hollow shell defining a ball striking surface and head body, the shell having an inner surface defining a hollow cavity. The inner surface includes a surface region opposed to and at least as large in area as the ball striking surface. A vibration dampener consisting of a thin layer of an elastomeric material is adhered to and covering substantially the entire area of the surface region. The thin layer dampens vibrations caused by the impact of the ball striking surface with a golf ball.

A vibration-dampened "iron"-type golf club is also described, and comprises a club shaft and an "iron"-type club head. The head comprises a head body defining a ball striking surface and a hollow cavity backing the ball striking surface, the cavity defined in part by a cavity base surface. The club further includes a vibration dampener consisting of a thin layer of an elastomeric material adhered to and covering substantially the entire area of the cavity base surface, the thin layer for dampening vibrations caused by the impact of the ball striking surface with a golf ball.

According to another aspect of the invention, a vibration-dampened golf putter club is described, comprising a club shaft, and a putter club head. The head comprises a putter head body defining a ball impacting surface and a hollow cavity backing the ball impacting surface. The cavity is defined in part by a cavity base surface. A vibration dampener consists of a layer of an elastomeric material covering substantially the entire area of said cavity base surface, the layer for dampening vibrations caused by the impact of the ball striking surface with a golf ball.

In accordance with further aspects of the invention, methods are described for fabricating the golf club heads.

BRIEF DESCRIPTION OF THE DRAWING

These and other features and advantages of the present invention will become more apparent from the following detailed description of an exemplary embodiment thereof, as illustrated in the accompanying drawings, in which:

FIGS. 2–9 illustrate steps in an exemplary method for fabricating the golf club head of FIG. 1. FIG. 2 is a simplified schematic diagram of an exemplary system for injecting a vibration dampening material in liquid form into a hollow wood-type golf club head.

FIG. 3 is a cutaway view of a hollow wood-type golf club head illustrating the step of injecting the liquid vibration dampening material into the golf club head using the system of FIG. 2.

FIG. 4 illustrates the step of shaking the golf club head after the liquid material has been injected to ensure that the liquid coats the inner surface of the hollow club head.

FIG. 6 shows the optional step of weighing the club head after an excess amount of liquid has been removed.

FIG. 7 shows the step of adding a volume of the liquid material sufficient to bring the club head mass up to a desired mass.

FIG. 8 shows the step of positioning the club head on a tilt so as to cause the excess liquid to flow to a desired position within the hollow club head.

FIG. 9 shows the step of oven curing the liquid vibration dampening material at an elevated temperature while the club head is positioned on the tilt.

FIG. 10 is a cross-sectional view of the club head of FIG. 1.

FIGS. 11 and 12 are close-up views of regions of the club head indicated by the phantom circles 11 and 12 of FIG. 10.

FIG. 19 shows a schematic diagram of a system for dispensing an elastomeric product in liquid form.

FIG. 20 shows the iron club head of FIG. 18 with a layer of liquid elastomeric material applied in accordance with the invention in the iron cavity.

FIG. 21 is a schematic representation of an oven curing step for curing the elastomeric material applied as shown in FIG. 20.

FIG. 22 is a cross-section view of the iron of FIGS. 20–21, with a layer of cured elastomeric material applied to the iron cavity in accordance with the invention.

FIG. 23 is a rear view of a golf putter-type club head, showing a cavity backing the ball impacting face.

FIG. 24 is a cross-sectional view of the putter of FIG. 23, taken along line 24—24.

FIG. 25 is a cross-sectional view of the putter head, showing the ball-impacting face lying on a flat, horizontal surface, with a layer of liquid vibration absorbing elastomeric material applied to the cavity.

FIG. 26 is a schematic representation of an oven curing step for curing the elastomeric material applied as shown in FIG. 25.

FIG. 27 is a cross-section view of the putter of FIGS. 25–26, with a layer of cured elastomeric material applied to the putter cavity in accordance with the invention.

DETAILED DESCRIPTION OF THE PREFERRED EMBODIMENT

Figure 1:
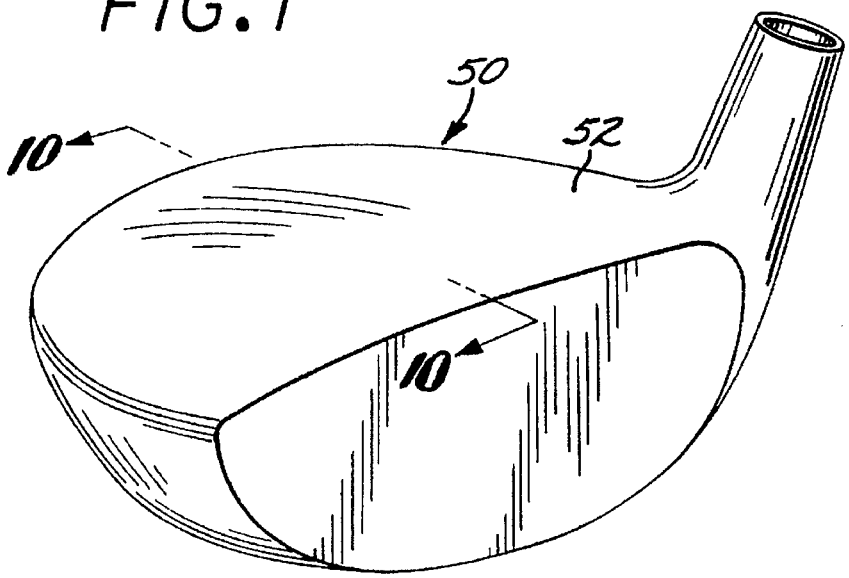
FIG. 1 is an isometric view of a wood-type golf club head embodying this invention.

FIG. 1 is an isometric view of a hollow wood-type golf club head 50 constructed with the vibration dampening system according to this invention. The club head 50 is fabricated of a thin hollow shell, which typically is a metal, but can alternately be a ceramic or other material. The shell includes an inner surface 70 (FIG. 3) which defines the shell cavity 56. As shown in FIGS. 10–12, the entire area of the interior surface of the shell 52 is coated in accordance with the invention with a thin layer 54 of a polyurethane elastomer. This layer completely coats the inner shell surface, and provides substantial vibration dampening. The layer changes the sound of the head impacting the ball, lowering the impact frequency. As a result, the feel of the club is improved, and the vibrational energy transferred to the club player is reduced.

One exemplary preferred material for the layer 54 is the F-70 A/B 70 Shore A polyurethane elastomer available from BJB Enterprises, Inc., 13912 Nautilus Drive, Garden Grove, Calif. 92643. This material is mixed from liquid parts A and B, with part A the polyurethane resin and part B the polyurethane curing agent. This exemplary material and its characteristics are further described in a product data sheet entitled "F-70A/B 70 Shore A Polyurethane Elastomer Ratio: 100/100."

Figure 2:
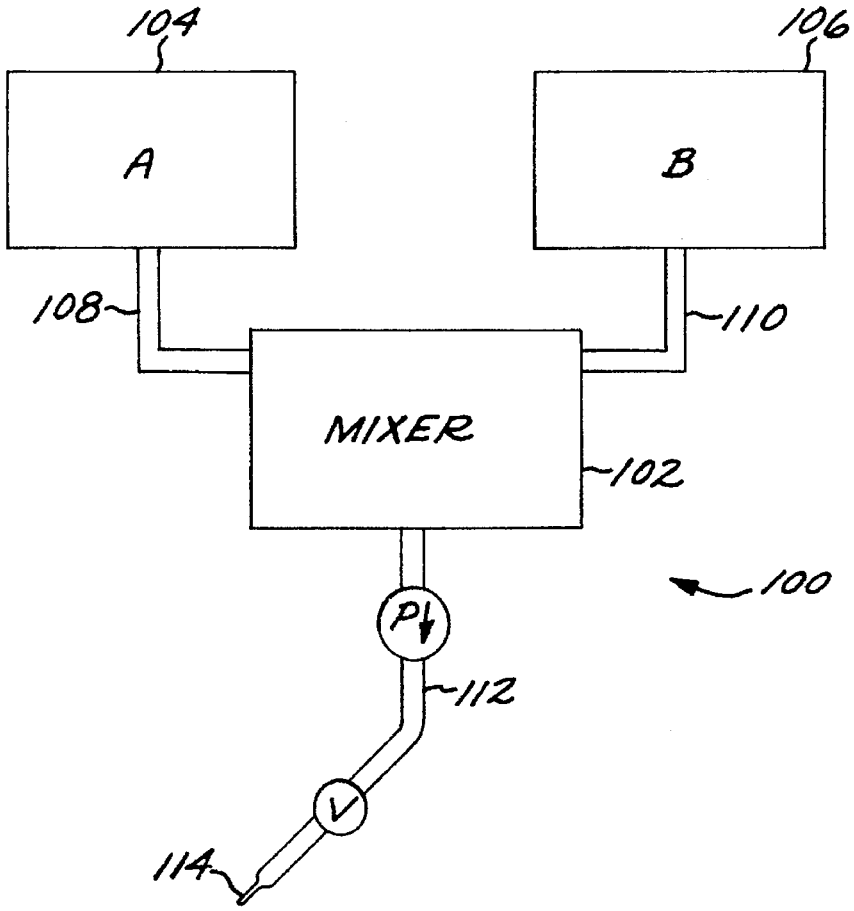

FIGS. 2–9 illustrate steps in an exemplary method for fabricating the golf club head 50 of FIG. 1. FIG. 2 is a simplified schematic diagram of an exemplary system 100 for injecting the vibration dampening material in liquid form into the hollow wood-type golf club head 50. The polyurethane elastomer is formed from two liquid parts A and B, which are mixed together when the elastomer is to be applied and allowed to cure. Thus, the parts A and B are each held in respective containers 104 and 106 in liquid form. The system includes a mixer 102 to which the containers are connected by tubes 108 and 110 to supply the parts A and B. In this exemplary embodiment, the mixer is a mechanical apparatus for mechanically mixing the two liquid parts, although the constituent parts could also be mixed statically. The mixer includes an impeller (not shown) which supplies the mixed product from the mixer to an outlet tube 112.

Figure 3:
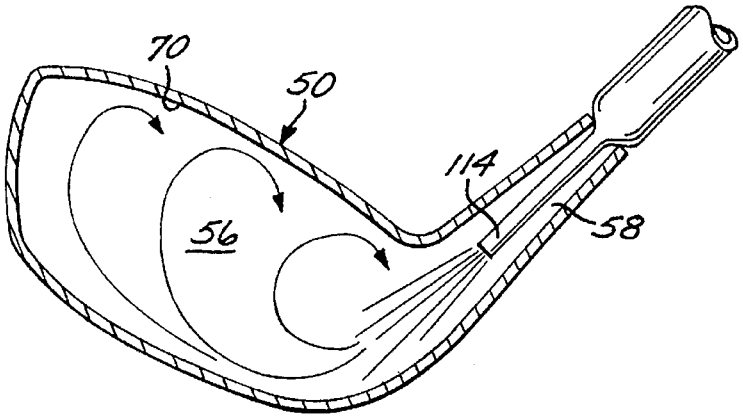

FIG. 3 is a cutaway view of the wood-type golf club head 50 illustrating the step of injecting the liquid vibration dampening material into the golf club head using the system 100 of FIG. 2. The tip 114 of the outlet tube 112 is inserted into the hosel opening 58 of the club head, which will ultimately receive the end of the club shaft. The mixed product of the parts A and B is in a thin liquid form and is emitted from the tip 114 under pressure. A quantity of the liquid is released into the hollow cavity 56 of the club head, typically on the order of 12 grams for one exemplary club head.

Figure 4:
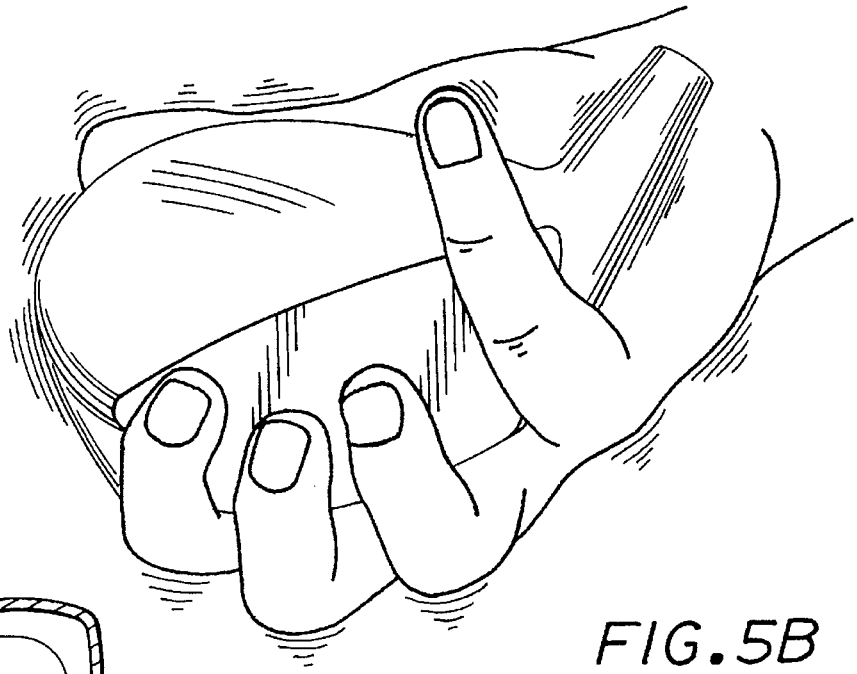

In the next step of the process, illustrated in FIG. 4, the club head 50 with the quantity of liquid material deposited therein is agitated, e.g., by hand, to coat the entire interior surface 70 of the club shell with this liquid.

Figure 5A:
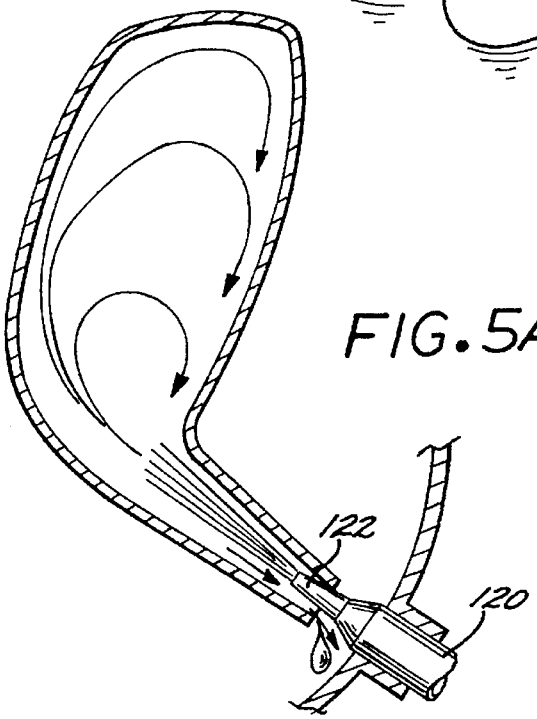
FIGS. 5A and 5B illustrate the step of removing excess liquid vibration dampening material using a stream of compressed air.

In the next step, illustrated in FIG. 5A, compressed air is released into the interior of the shell through the hosel opening, creating turbulence within the cavity 56 and ejecting excess liquid material. This is accomplished in an exemplary embodiment by the arrangement shown in FIG. 5B, wherein pressurized air, e.g., at about 25 psi, is released through tube 120 and nozzle 122 into the cavity 56 with the club head held at an inverted attitude. A shroud 124 collects the excess liquid which drips from the hosel opening.

Figure 5B:
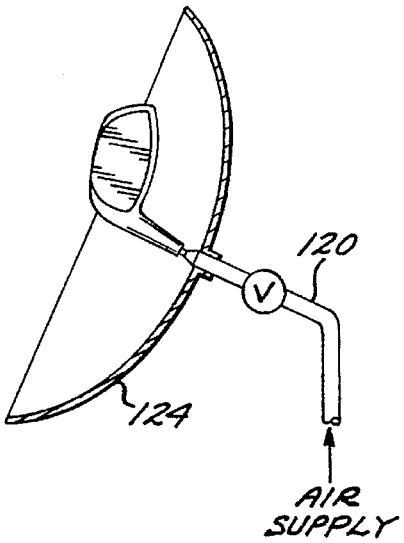

FIG. 6 shows the next (optional) step of weighing the club head 50 with a weight scale 130 after an excess amount of liquid has been removed as shown in FIG. 5B. There are PGA regulations which govern the permissible range of club head weights, and so each type of club head is typically constructed by the manufacturer to have a predetermined weight or mass. The shell 52 of the head can be designed and constructed to have a nominal weight which is a large percentage of the ultimate desired club weight, leaving a small portion of the weight to be supplied by the vibration dampening material. The purpose of the weighing step as shown in FIG. 6 is to determine the weight of the head 50 after the liquid elastomer has been applied and before this material has been cured. Typically, the head is designed to leave the head somewhat lighter than the nominal finished weight after the liquid elastomer has been applied. The weighing process determines how much additional weight can be added to the club head 50 to bring its weight up to the nominal finished weight. This additional weight is the supplied by pouring another volume of the liquid elastomer into the hollow cavity 56 through the hosel opening 58, preferably while the head is on the weight scale 130, as shown in FIG. 7. This permits the desired finished weight to be accomplished precisely at this stage of the processing.

FIG. 8 shows the step of positioning the club head on a tilt so as to cause the excess liquid added as shown in FIG. 7 to flow to a desired position within the hollow club head. This is to achieve a desired weighting of the club head. For example, the manufacturer may typically desire to add the additional weight toward the rear of the head, away from the striking face 60. This can be achieved by securing rods or dowel 140 under the head face 60, lifting this part of the club head in relation to the rear area 64 of the head. Another rod or dowel 142 can be positioned at the rear of the club head to prevent the head from sliding or rolling off the dowel 140. Both dowels 140 and 142 are supported on a flat surface 144 in this exemplary fixture. As a result of the tilted position of the club head, the excess liquid elastomer material flows to the rear area 64 and pools there, forming a thickened region 62 of the elastomer. This will achieve a rear weighting of the club head, due to the mass of the thickened region 62. Of course, other weighting configurations may alternatively be employed by tilting the head so that the toe or heel of the club is the lowest point, so that the extra liquid elastomer pools at the toe or heel.

Next, FIG. 9 shows the step of oven curing the liquid vibration dampening material at an elevated temperature while the club head 50 is positioned on the tilt. Thus, the flat surface 144 may be a sheet of plywood or metal which can readily be moved into a curing oven 150, so that the head 50 can be heated for some desired period of time to cure the polyurethane elastomer material to a solidified state. For the exemplary material described above, the head can be baked for a period of two hours at a temperature in the range of 160 degrees Fahrenheit to 200 degrees Fahrenheit. Once the material has cured, the head 50 can be removed from the oven, allowed to cool, and the shaft fitted to the hosel opening 58 in the conventional manner to complete the fabrication process.

Preferably, the thickness of the layer of elastomer is in the range of 5 to 10 mils about the interior surface of the cavity, although the thickness in the optional thickened region 62 will of course depend upon the amount of mass added to bring the head up to the finished weight.

The finished golf club is found to have improved vibration dampening, so that the vibration frequency of energy imparted upon ball impact is reduced. This affects the impact sound, and improves the comfort and feel of play with the metal wood over conventional metal woods.

Figure 13:
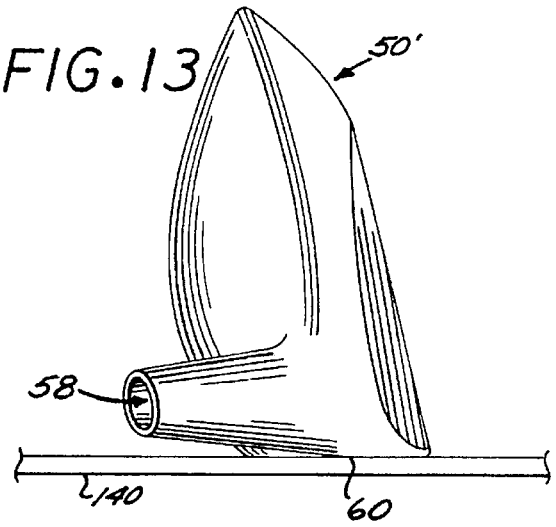
FIG. 13 illustrates a step of an alternate method for fabricating a hollow wood-type golf club head in accordance with the invention.
Figure 14:
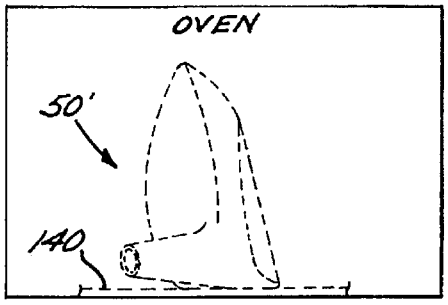
FIG. 14 illustrates a heating/curing step of the alternate fabrication method.
Figure 15:
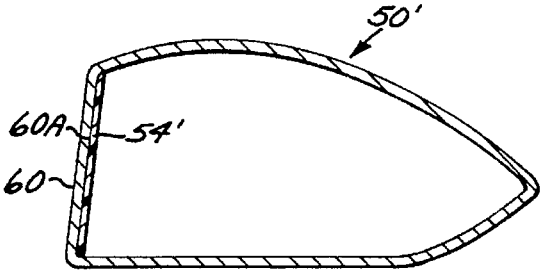
FIG. 15 is a cross-sectional view of a hollow wood-type golf club head fabricated in accordance with the alternate method of FIGS. 13 and 14.
Figure 16:
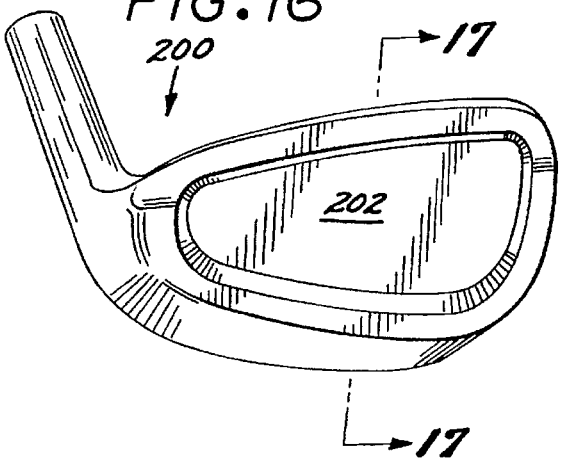
FIG. 16 is a rear view of a golf iron club head, showing a cavity behind the ball impacting face.

FIGS. 13–15 illustrate an alternate embodiment of a wood-type hollow metal club head 50' in accordance with the invention. In this embodiment, a measured quantity of the liquid mixture, e.g. produced by the mixing system 100 shown in FIG. 2, is dispensed into the hosel opening 58 of the hollow club head. The liquid can be dispensed directly from nozzle 114 of the system 100, or from a syringe. In this embodiment, the entire interior surface of the club head is not coated with the elastomeric material. Instead, only the rear surface 60A of the ball impacting face 60 is coated with a layer 54' (FIG. 15) of the elastomeric material. This is accomplished by positioning the club head face on a horizontal surface 140, typically after the quantity of liquid material has been dispensed into the interior of the club head, although the liquid material could alternatively be dispensed into the hosel opening after the club head has been placed in the position shown in FIG. 13.

Once the quantity of liquid material has been dispensed into the hosel opening and the club head positioned as shown in FIG. 13, the liquid will flow to cover the interior surface of the face 60, to a layer depth determined by the size of the face 60 and the quantity of material dispensed into the club head. The typical thickness is in the range of 5 mils to 10 mils, although the thickness can be adjusted to provide a desired amount of added mass to bring the club head up to a desired weight. Thus, the club head can be weighed, and an additional quantity of liquid elastomer material dispensed into the hosel opening to achieve a desired club head weight.

FIG. 14 illustrates an oven curing step in the process of fabricating the head 50', wherein the head is heated for a period of time to cure the liquid material such that it assumes a solid state. For the exemplary material described above, the head can be baked for a period of fifteen minutes to two hours at a temperature in the range of 160 degrees Fahrenheit to 200 degrees Fahrenheit. Once the material has solidified, the head 50' can be removed from the oven, allowed to cool, and the shaft fitted to the hosel opening 58 in the conventional manner to complete the fabrication process.

FIGS. 16–22 illustrate another embodiment of the invention, wherein a layer of the elastomeric material is applied to a cavity 202 backing an iron-type golf club head 200. The "iron" head 200 is typically fabricated of materials such as stainless steel, titanium or its alloys, ceramics, ABS or the like. One preferred material is stainless steel, which is forged to the configuration shown in FIG. 16.

Figure 17:
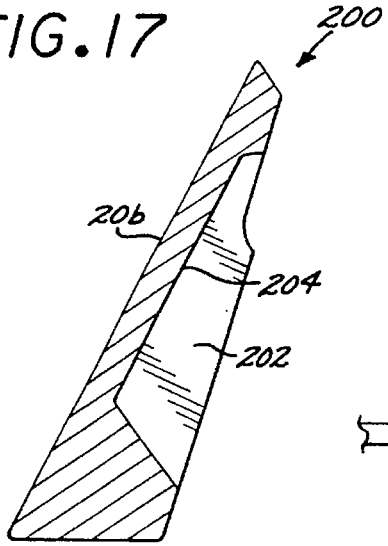
FIG. 17 is a cross-sectional view of the iron of FIG. 16, taken along line 17—17.
Figure 18:
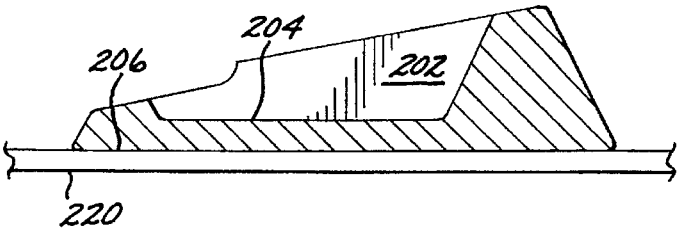
FIG. 18 is a cross-sectional view of the iron, showing the ball-impacting face lying on a flat, horizontal surface in preparation for applying a vibration absorbing elastomeric material.

FIG. 17 is a cross-sectional view of the iron head 200, showing the cavity 202, the base surface 204 of the cavity, and the club ball impacting surface 206. In this exemplary embodiment, the cavity base surface 204 is generally parallel to the ball impacting face 206. This facilitates the ready positioning of the club head 200 so that the cavity base surface is horizontal, by placement of the club head surface 206 on a horizontal fixture surface 220. If the cavity base surface 206 is not parallel to the face 204, then the fixture can be tilted relative to horizontal so as to position the surface 206 horizontal. Alternatively, positioning the surface 204 at an offset angle relative to the horizontal can be used to provide a desired weighting by having a thicker elastomer layer at one region of the cavity than at another.

The same elastomer product can be used to provide an elastomeric layer in the cavity 202 as described above in connection with the wood-type club head embodiment as described in connection with FIGS. 1–12. However, this product cures to a cloudy, grayish color, which may not be ascetically pleasing for many applications, since the elastomer layer will be visible on the finished golf iron. Thus, for many applications, it is desirable to use an elastomer product which cures to a relatively clear state. Such a product is available from the same vendor for the product described above, as product WC-575 A/B, water clear aliphatic polyurethane elastomer. It is supplied in parts A and B, which are mixed together to form the elastomeric liquid material. The elastomer is a clear, colorless urethane elastomer, which can be tinted with colorants to provide a color tinting, if desired for a particular club application.

FIG. 19 shows an simplified representation of a system for mixing the components of the elastomeric material and dispensing the resultant liquid. Mixing of the two parts A and B (from respective containers for each part, which are not shown in FIG. 19), is performed by mixing apparatus 252. The mixed liquid product is pumped under control of a transfer pump 234, which may in an exemplary implementation be part of the mixing apparatus, into a container 236. Because the mixing operation will typically result in air bubbles becoming entrapped in the liquid, which would impair the appearance of the clear, cured elastomer, the container 236 is placed in a vacuum chamber 238. Vacuum is applied to the chamber by evacuation pump 239, and the air bubbles are drawn out of the mixture liquid. Thereafter, the mixture can be dispensed from the container for use, e.g. through a metering pump 242 which is operated for timed intervals to dispense a metered amount of the liquid material. A control panel 246 is shown schematically in FIG. 19 for illustrating an apparatus for controlling the pumps 254, 239 and 242.

FIG. 20 shows the iron club head 200 in place on the fixture surface 220, after a quantity of liquid elastomer material has been dispensed into the cavity 202. The amount of material is sufficient to cover the cavity base surface 204, to a depth typically on the order of one-sixteenth to one-quarter inch, and for some applications, the elastomer will substantially fill the cavity. The particular amount of elastomer will also be determined in some applications by a need to add a certain weight to the finished club to bring the club head up to a predetermined weight. This can be determined by weighing the club head after dispensing the liquid, but before curing has occurred, and adding liquid if need to bring the club head weight up to a certain weight. The elastomer material is then cured with the head in the position illustrated in FIG. 21 until the elastomer material has solidified. This is illustrated in FIG. 21 by oven 240, in which the head is heated to accelerate curing, say at 160 degrees F. to 200 degrees F., for 15 minutes to 2 hours. Once the liquid has cured to a solid state, the head can be removed from the oven, and permitted to finish curing in air. The resulting finished club head is shown in FIG. 22.

FIGS. 23–27 illustrate a further embodiment of the invention, wherein an absorbing elastomer layer 256 is applied to a cavity 252 backing the ball impacting face 254 of a golf putter-type club head 250. In this exemplary application, an adhesive label 260 showing a logo ("GOLF CO." as an illustration) is attached to the cavity base surface 258, and the elastomer layer 256 is applied to the label. With a clear or color tinted elastomer layer 256, shown in the cross-sectional view of FIG. 24, showing the putter 250 prior to applying the elastomer layer 256, the label is protected from the elements.

Generally, the thickness of the layer 256 can be substantially greater than the thickness applied to the wood head, and in this exemplary embodiment substantially fills the cavity. An exemplary layer thickness is one-sixteenth to one-quarter inch.

The process for applying the elastomer layer 256 is generally shown in FIGS. 25 and 26. In this exemplary embodiment, the cavity base surface 258 is parallel to the ball impacting face 25. The face 254 of the club head 250 is laid on a horizontal fixture plate 262, also positioning the base surface 258 on the horizontal. The elastomer material which has been mixed, and the air bubbles extracted, using an apparatus as generally shown in FIG. 20, is dispensed into the cavity 252, substantially filling the cavity. The liquid elastomer material forming the layer 256 is then allowed to cure to a solid state. The curing can be accelerated using a curing oven 270 as shown in FIG. 26, at a temperature of 140 to 160 degrees for 15 minutes to 2 hours or longer. The finished putter head is shown in FIG. 27 in cross-section.

The application of the elastomeric dampener layer to an exterior cavity surface provides protection against rust and collection of dirt, while allowing the club head weight to be controlled to provide a desired weight. Moreover, by color tinting the layer, a desirable color accent can be applied to the club head cavity.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A vibration-dampened hollow "wood"-type golf club, comprising:

a club shaft; and a "wood"-type club head, comprising a hollow shell defining a ball striking surface and head body, the shell having an inner surface defining a hollow cavity, said inner surface including a surface region opposed to and at least as large in area as the ball striking surface, and a vibration dampener consisting of a thin layer of an elastomeric material adhered to and covering substantially the entire area of said surface region, the thin layer for dampening vibrations caused by the impact of the ball striking surface with a golf ball, wherein said thin layer of elastomeric material is attached to said surface region of said inner surface without any intermediate coating or adhesive between said thin layer and said surface region of said inner surface.

2. The golf club of claim 1 wherein the thin layer has a thickness in the range of five to ten thousandths of an inch.

3. The golf club of claim 1 wherein the elastomeric material is a polyurethane elastomer.

4. The golf club of claim 1 wherein the elastomeric material has a Shore hardness rating in the range of 70–72.

5. The golf club of claim 1 wherein said shell is fabricated of a metal.

6. A method of fabricating a vibration-dampened "wood"-type golf club, comprising:

providing a hollow "wood"-type shell club head having a hosel with a hosel opening defined therein, the shell club head defining an interior hollow cavity and an exterior ball impacting face, the hosel opening in communication with the cavity, the shell club head including an interior shell surface defining the cavity, said interior shell surface comprising a surface region opposed to and at least as large in area as the ball striking surface;

dispensing a quantity of elastomer material in a liquid, uncured state into the cavity;

supporting the club head so that said interior surface region is generally horizontal, wherein the quantity of elastomer material in a liquid state pools within said cavity to come into direct contact with and cover said interior surface region;

while supporting said club head so that said interior region is generally horizontal, allowing the elastomer material to cure to a solid state to define a thin layer of solid elastomer adhered directly to substantially the entire area of said inner surface region without any intermediate coating or adhesive between the thin layer of elastomer and the inner surface region, thereby providing a vibration-dampening function; and attaching a club shaft to the hosel.

7. The method of claim 6 wherein said step of allowing the elastomer to cure includes baking the club head in an oven at an elevated temperature for a period of time.

8. The method of claim 6 wherein said elastomer is a polyurethane elastomer.

9. The method of claim 6 wherein said elastomer has a Shore hardness rating in the range of 70–72.

10. The method of claim 6 wherein said elastomer layer has a thickness in the range of five to ten thousandths of an inch.

11. A vibration-dampened "iron"-type golf club, comprising:

a club shaft; and an "iron"-type club head, comprising a head body defining a ball striking surface and a hollow cavity backing the ball striking surface, the cavity defined in part by a cavity base surface; and a vibration dampener consisting of a homogeneous lightweight layer of an elastomeric material adhered to and covering substantially the entire area of said cavity base surface, wherein said layer of elastomeric material is attached to said cavity base surface without any intermediate coating or adhesive between said thin layer and said cavity base surface, and wherein an outer surface of said layer is exposed to the environment with no coatings or structures attached to said outer surface of said layer, said homogeneous layer of elastomeric material for dampening vibrations caused by the impact of the ball striking surface with a golf ball.

12. The golf club of claim 11 wherein the layer has a thickness in the range of one-sixteenth to one-quarter of an inch.

13. The golf club of claim 11 wherein the elastomeric material is a polyurethane elastomer.

14. The golf club of claim 11 wherein the elastomeric material has a Shore hardness rating in the range of 70–72.

15. The golf club of claim 11 wherein said club head body is fabricated of a metal.

16. The golf club of claim 11 wherein said base cavity surface is generally parallel to the ball impacting face.

17. The golf club of claim 11 wherein said layer of elastomeric material is translucent.

18. The golf club of claim 11 wherein said layer of elastomeric material is tinted with a colorant to produce a layer having a visible color shade.

19. The golf club of claim 11 wherein said layer of elastomeric material is free of any air bubbles.

20. The golf club of claim 11 wherein the layer of elastomeric material has a uniform thickness.

21. A method of fabricating a vibration-dampened "iron"-type golf club, comprising:

providing a "iron"-type club head body, the club head body defining an exterior ball impacting face and exterior hollow cavity backing the face, the club head body including a base cavity surface defining the cavity;

positioning the club head body so that said base cavity surface is generally horizontal;

dispensing a quantity of homogeneous elastomer material in a liquid, uncured state into the cavity so that said elastomer pools at the base of the cavity to form a layer covering the base cavity surface;

while supporting said club head so that said base cavity surface is generally horizontal, allowing the elastomer material to cure to a solid state to define a lightweight homogeneous layer of solid elastomer adhered to substantially the entire area of said base cavity surface, thereby providing a vibration-dampening function, wherein said layer of elastomeric material is attached to said base cavity surface without any intermediate coating or adhesive between said thin layer and said base cavity surface, and wherein an outer surface of said layer is exposed to the environment with no coatings or structures attached to said outer surface of said layer; and attaching a club shaft to the hosel.

22. The method of claim 21 wherein said step of allowing the elastomer to cure includes baking the club head in an oven at an elevated temperature for a period of time.

23. The method of claim 21 wherein said elastomer is a polyurethane elastomer.

24. The method of claim 21 wherein said elastomer has a Shore hardness rating in the range of 70–72.

25. The method of claim 21 wherein said elastomer layer has a thickness in the range of one-sixteenth to one-quarter of an inch.

26. The method of claim 21 further comprising the step of removing any air bubbles from the liquid elastomer prior to dispensing said liquid elastomer into said cavity.

27. The method of claim 21 wherein the layer of elastomeric material has a uniform thickness.

28. A vibration-dampened golf putter club, comprising:

a club shaft; and a putter club head, comprising a putter head body defining a ball impacting surface and a hollow cavity backing the ball impacting surface, the cavity defined in part by a cavity base surface;

a thin label insert element attached to said cavity base surface;

a vibration dampener consisting of a translucent lightweight layer of an elastomeric material covering substantially the entire area of said cavity base surface and said label insert element, said layer attached to said label insert, wherein an outer surface of said layer is exposed to the environment with no coatings or structures attached to said outer surface of said layer so that said label insert element is visible through the translucent layer, the layer for dampening vibrations caused by the impact of the ball striking surface with a golf ball.

29. The golf club of claim 28 wherein the elastomeric material is a polyurethane elastomer.

30. The golf club of claim 28 wherein the elastomeric material has a Shore hardness rating in the range of 70–72.

31. The golf club of claim 28 wherein said club head body is fabricated of a metal.

32. The golf club of claim 28 wherein said base cavity surface is generally parallel to the ball impacting face.

33. The golf club of claim 28 wherein the elastomer layer substantially fills the cavity.

34. A method of fabricating a vibration-dampened golf putter club, comprising:

providing a putter club head body, the club head body defining an exterior ball impacting face and exterior hollow cavity backing the face, the club head body including a base cavity surface defining the cavity;

attaching a thin label insert element to said base cavity surface;

positioning the club head body so that said base cavity surface is generally horizontal;

dispensing a quantity of translucent elastomer material in a liquid, uncured state into the cavity so that said elastomer pools at the base of the cavity to form a layer covering the base cavity surface and the label insert element;

while supporting said club head so that said interior region is generally horizontal, allowing the elastomer material to cure to a solid state to define a translucent layer of solid elastomer adhered to said label insert element and covering substantially the entire area of said base cavity surface, thereby providing a vibration-dampening function; and attaching a club shaft to the hosel.

35. The method of claim 34 wherein said step of allowing the elastomer to cure includes baking the club head in an oven at an elevated temperature for a period of time.

36. The method of claim 34 wherein said elastomer is a polyurethane elastomer.

37. The method of claim 34 wherein said elastomer has a Shore hardness rating in the range of 70–72.

* * * * *